US011358021B2

(12) United States Patent
Harding et al.

(10) Patent No.: US 11,358,021 B2
(45) Date of Patent: Jun. 14, 2022

(54) FOOT SLIP FOR SECUREMENT OF EXERCISE BANDS

(71) Applicant: Neil D. Harding, Canton, OH (US)

(72) Inventors: Neil D. Harding, Canton, OH (US); Jonathan A. Hallsten, Barberton, OH (US); Robert G. Martinez, Akron, OH (US)

(73) Assignee: Neil Harding, Canton, OH (US)

( * ) Notice: Subject to any disclaimer, the term of this patent is extended or adjusted under 35 U.S.C. 154(b) by 0 days.

(21) Appl. No.: 16/579,140

(22) Filed: Sep. 23, 2019

(65) Prior Publication Data

US 2021/0086020 A1 Mar. 25, 2021

(51) Int. Cl.

*A63B 21/00* (2006.01)
*A63B 21/04* (2006.01)
*A63B 21/055* (2006.01)

(52) U.S. Cl.

CPC .... *A63B 21/4015* (2015.10); *A63B 21/00185* (2013.01); *A63B 21/04* (2013.01); *A63B 21/0552* (2013.01); *A63B 21/4035* (2015.10)

(58) Field of Classification Search

CPC ..... A63B 21/00058; A63B 21/00061; A63B 21/00065; A63B 21/00178; A63B 21/00181; A63B 21/00185; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/08; A63B 21/4011; A63B 21/4015; A63B 21/4033; A63B 21/4034; A63B 21/4035; A63B 21/4039

See application file for complete search history.

(56) References Cited

U.S. PATENT DOCUMENTS 1,618,273 A * 2/1927 Davidson ..... A63B 21/0004 482/124
3,256,015 A * 6/1966 Perrin ..... A63B 21/04 482/129
3,402,485 A * 9/1968 McMorrow ..... A43B 3/00 36/25 R
3,506,000 A 4/1970 Baker
3,752,474 A 8/1973 Macabet
4,251,070 A * 2/1981 Leseberg ..... A63B 21/154 36/50.1

(Continued)

*Primary Examiner* — Gary D Urbiel Goldner
(74) *Attorney, Agent, or Firm* — Emerson Thomson Bennett; Roger D. Emerson, Esq.

(57) ABSTRACT

The present invention relates to an exercise aid device which is placed over top of a user's foot. The exercise aid device has a base, a raised backing, and two sidewalls positioned about opposing sides of one another. The two sidewalk extend towards one another at the front end of the base, forming a band which provides for a first opening. A foot may be placed through the first opening, and held securely in place by the combination of the band and the raised backing. An exercise band may be looped through an opening which extends from one sidewall to the opposing sidewall and through the base, or may be affixed to the device by a securement placed on the exterior of the device to attach resistance cables such that the exercise aid device serves as an anchoring unit during exercise routines.

16 Claims, 10 Drawing Sheets

(56) References Cited

U.S. PATENT DOCUMENTS 4,371,161 A 2/1983 Williams
4,535,554 A 8/1985 De Obaldia
4,596,387 A 6/1986 Roberts
4,728,103 A 3/1988 Fulton
4,940,437 A 7/1990 Piatt
5,016,623 A * 5/1991 Krahenbuhl ..... A61F 13/066 128/882
5,025,802 A 6/1991 Laico
5,100,129 A 3/1992 Porter
5,186,698 A 2/1993 Mason
5,186,701 A * 2/1993 Wilkinson ..... A41D 31/185 482/125
5,203,754 A 4/1993 MacLean
5,306,222 A * 4/1994 Wilkinson ..... A63B 21/4035 482/124
5,490,826 A 2/1996 Rose
5,545,113 A 8/1996 Bobich
5,695,437 A 12/1997 Olschansky
5,711,747 A 1/1998 Steinback
5,713,142 A 2/1998 Ahmed Fahmey El-Circy
5,782,727 A * 7/1998 Pierce ..... A63B 21/0552 482/121
5,792,034 A 8/1998 Kozlovsky
5,993,362 A 11/1999 Ghobadi
6,059,062 A * 5/2000 Staelin ..... B60L 15/2009 180/181
6,425,844 B1 * 7/2002 Azar ..... A61H 1/0259 482/123
6,875,135 B2 4/2005 Tracy, Sr.
7,087,003 B1 8/2006 Katterjohn
7,578,775 B2 8/2009 Terry
7,608,026 B1 10/2009 Nicassio
7,955,236 B2 6/2011 Digiovanni
8,075,462 B1 12/2011 Hinds
8,142,336 B1 * 3/2012 Yates ..... A63B 23/0405 482/124
8,915,827 B2 12/2014 Cranke et al.
9,056,218 B2 6/2015 Zoltak
9,272,178 B2 3/2016 Pinder
9,630,081 B2 4/2017 Gillespie
9,700,752 B1 7/2017 Powers
9,821,189 B1 11/2017 Saar
2003/0114275 A1 * 6/2003 Falbo, Sr. ..... A63B 21/4011 482/57
2003/0145489 A1 * 8/2003 Major ..... A43C 15/063 36/7.7
2005/0043150 A1 2/2005 Nitta et al.
2005/0193588 A1 * 9/2005 Dombowsky ..... A43B 3/16 36/7.5
2006/0183609 A1 8/2006 Flynn
2007/0060454 A1 3/2007 Vogel
2008/0178492 A1 * 7/2008 Coomer ..... A43B 3/16 36/7.5
2008/0184592 A1 * 8/2008 Brie ..... B29D 35/04 36/7.1 R
2009/0075789 A1 3/2009 Hetrick
2009/0100721 A1 * 4/2009 Gorynski ..... A43B 13/189 36/135
2009/0235556 A1 * 9/2009 Reid ..... A43B 3/163 36/7.1 R
2009/0239723 A1 9/2009 Jovanovic
2009/0286661 A1 * 11/2009 Campbell ..... A63B 21/0023 482/124
2009/0307931 A1 * 12/2009 May ..... A43C 13/08 36/132
2010/0274163 A1 10/2010 Terrio
2012/0283077 A1 * 11/2012 Cranke ..... A63B 23/03575 482/124
2013/0067767 A1 3/2013 Casto
2013/0090218 A1 * 4/2013 Johnson ..... A63B 21/0442 482/124
2013/0231227 A1 9/2013 Ranieri
2013/0333097 A1 * 12/2013 Cranke ..... A63B 21/4043 2/300
2014/0148315 A1 * 5/2014 Thompson ..... A63B 23/0211 482/105
2014/0171276 A1 6/2014 Strachan
2014/0342884 A1 11/2014 Aldridge et al.
2015/0342297 A1 12/2015 Garza, Jr.
2016/0101309 A1 * 4/2016 Schreiber ..... A63B 21/4019 482/124
2016/0256732 A1 9/2016 Kasner
2016/0296787 A1 * 10/2016 Kamins ..... A63B 21/4013
2016/0345656 A1 * 12/2016 Ramirez, II ..... A43B 5/18
2017/0028244 A1 * 2/2017 Schreiber ..... A63B 21/4043
2018/0078813 A1 * 3/2018 Saar ..... A63B 21/15
2018/0290009 A1 * 10/2018 Avila ..... A61H 1/0266
2018/0318639 A1 * 11/2018 Kim ..... A63B 21/023
2019/0053575 A1 * 2/2019 Austin ..... A43B 13/22
2020/0206556 A1 * 7/2020 Souffrain ..... A63B 24/0062

* cited by examiner

FOOT SLIP FOR SECUREMENT OF EXERCISE BANDS

TECHNICAL FIELD

The present invention relates generally to fitness and exercise equipment. More particularly, this invention is directed to a device capable of being used in conjunction with a number of different types of fitness and exercise bands and similar resistance training equipment. Specifically, this invention is a slip which is placed over the foot of an individual, securing to the posterior of the heel and trapping a resistance band under the foot of the user inside the slip, and allows for resistance training devices to be attached to a number of different securement locations located about the exterior of the slip.

BACKGROUND

A common manner or method of exercising involves the use of resistance bands, otherwise commonly referred to as exercise bands, rubber bands, fitness stretch bands, resistance tubes, stretch cords, stretch bands, as well as a number of other names. The purpose of these bands is to provide a user with resistance targeted to a specified muscle or muscle grouping. As the band contains a certain predetermined amount of tension, the user must overcome this tensile force in order to work the band in the desired manner. The user's muscles contract to generate a stabilizing force in view of the resistance being supplied by the band.

The use of most resistance bands requires an anchoring unit in order to properly stabilize the bands themselves, thus allowing for this resistive force to be utilized for strength training. One example of this may be seen as commonly employed in a gym or other commercial exercise environment, wherein the resistance bands are affixed to an anchoring unit or machine such that they are substantially immovable. However, the more common example of resistance bands is that of the more mobile, "at-home" version wherein the bands are affixed with a handle about either opposing end, as well as an optional clip, hook, or other type of fastening device so as to affix the band to some sort of additional component or structure. When using this type of band, the anchoring unit can be affixed to the fastening device of the band, or alternatively may be supplied by the user themselves. The most common example of the user supplying the band with an anchoring unit is by simply placing a portion of the band underneath the user's feet, thereby enabling the user to utilize their own weight so as to anchor the bands in place and allow for the resistive forces to be properly utilized.

More specifically, when utilizing the feet of the user as the anchoring means, the bands are engaged with the user's feet typically by being placed underneath the ball portion or arch of the foot. This provides for the greatest security, as this portion of the foot tends to make the greatest contact with the ground surface below (as opposed to that of the arch of the foot, which may lack any contact whatsoever, or the heel, which tends to be of a round nature, thereby lacking sufficient contact with the ground). When the band is placed in this position, it can create a certain amount of torque on the ankle and ankle joint of the user. As a result of this torque, the user's foot (or feet, if placing the band under both) may begin to move. The movement of the user's feet need not be significant in order to cause the band to become disengaged, as there tends to be no further securement to the foot other than that supplied by the user's own weight. If the band becomes dislodged, the user's workout or exercise routine becomes immediately interrupted, as well as creating a potentially dangerous condition as the band, which was originally under great tension, has now suddenly been freed from its anchoring unit and may rebound with sufficient force to cause harm to the user or those situated in near proximity to the user.

Additional negative aspects of utilizing one's feet as the anchoring unit for these resistance bands may be observed as a result of movement of the band beneath one's feet. Any amount of movement of the band, no matter how slight, while it may not cause the band to become completely dislodged as discussed above, will affect the stability of the bands, thereby causing a change in the resistive force being experienced by the user. This type of inconvenience often results in user's becoming aggravated with their use of the resistance bands, as they are not able to experience a workout routine of uniform application. One common and frustrating example of this may be when the band slides about a horizontal axis beneath the user's foot. This lateral movement results in the band now being "off-center." In application, this may cause the user to have an uneven length of travel for the desired exercise, which severely alters the effectiveness of the resistive force being supplied by the bands to the user's muscles. While there are scenarios in which this type of offset or uneven resistance is desired, generally a user will be seeking symmetrical resistance about the length of the bands. Alternatively, and as alluded to above, the bands may travel about the vertical axis beneath the user's foot, resulting in a lack of stability necessary for proper strength resistance exercise.

In order to address the above problems, attempts have been made to create a corresponding feature to be placed on the foot of the user in order to more properly secure the bands thereto. Previous attempts have failed to provide a safe yet versatile design which allows for this type of securement to the foot or shoe of a user. For example, certain designs require the user to be wearing a shoe in order to affix the covering, either for securement or comfort purposes, as the coverings may be of a rather rugged construction which may cause injury if worn on a bare foot or a foot covered only by a sock or stocking. This can be tedious and unattractive to those who wish to utilize the bands in the comfort of their own home. Other variations include a number of straps or other similar means of securement, which can also be quite tedious to set and adjust, as well as often times having a particularly short lifespan, as the bands or straps do not tend to hold up over time when subjected to continuous use.

Another common problem associated with current designs is that they may lack versatility in the location or angle of attachment for the bands. For example, some coverings may only have a single location at which the band may be secured. This may, in extreme circumstances, limit the utility of the bands as to their application to certain exercises or, more commonly, reduce the effectiveness of the bands by altering the amount of resistive force able to be supplied. These issues may be compounded by the manner in which the resistive force effects the foot of the user, as the location of the securement point, coupled with the manner in which the cover contacts the foot, can create an uncomfortable or even painful result for the user, as the bands cause a pulling or tugging sensation on a focused area of the foot where the cover begins to press.

A need thus exists for a foot covering which is compatible with a wide variety of resistance training bands and which is able to overcome the shortcomings identified above.

SUMMARY

The present invention relates to an exercise aid device capable of being placed over top of a user's foot. The exercise aid device has a base, a raised backing which extends upward and away from the base, two sidewalls positioned about opposing sides of one another and forming together about the front face of the base to create a band which provides for a first opening, and a means of securement on the exterior of the device. The toe region of a user's foot can be inserted through the first opening created by the intersection of the first and second sidewalls creating the band.

After inserting the toe region of the user's foot through the first opening, the raised backing may then be extended away from the first opening, the underside of the foot is then placed flat along the surface of the base. The raised backing is then released, causing it to contract back towards the first opening and come to a rest upon the posterior of the heal of the foot. At least one opening may span the entirety of the width of the base, running from the first sidewall to the second sidewall. This opening may receive an exercise band such that it "loops" underneath the foot of the user and is secured in the absence of any additional external means of securement. A resistance cable, or multiple resistance cables, may then be secured to the exercise aid device. The exercise aid device may be used with at least one resistance cable in order to aid in various different types of exercise routines. Alternatively, or in addition to the opening capable of receiving a resistance cable, at least one resistance cable may then be attached to the means of securement. As the user begins to exercise with the resistance cable, the exercise aid device provides a stable and secure base in order to anchor the cable.

Another embodiment of the exercise aid device consists of a device to be placed over a user's foot having a base with a substantially flat surface. A raised backing is placed perpendicular to, and extends upward and away from, the base, in addition to a series of two sidewalls placed about opposing sides of one another. A first opening which is semicircular in shape is created by the intersection of the first and second sidewalls as they extend up and over the surface of the base, forming a band at the intersection. At least one additional opening may span the entirety of the width of the base, running from the first sidewall to the second sidewall. This opening may receive an exercise band such that it "loops" underneath the foot of the user and is secured in the absence of any additional external means of securement. Alternatively, or in addition to the opening capable of receiving a resistance cable, a series of O-ring type securement points are positioned about the exterior of the exercise aid device, with one being positioned on the exterior of the raised backing, and the remaining two being positioned about opposing sides of the band. A user may insert the toe region of the foot into the first opening. The raised backing may then be expanded away from the first opening to allow the remainder of the user's foot to be placed within the exercise aid device. The raised backing may then be released, allowing it to contract back towards the first opening and come to rest upon contacting the posterior of the heel of the user's foot. Any different number of resistance cables may then be attached to the O-ring type securement points as needed by the user according to the exercise being performed, with the exercise aid device serving as an anchoring unit in order to properly stabilize the resistance cables during use.

BRIEF DESCRIPTION OF THE DRAWINGS

The accompanying drawings in the following description illustrate various embodiments of the present disclosure.

DETAILED DESCRIPTION

Figure 1:
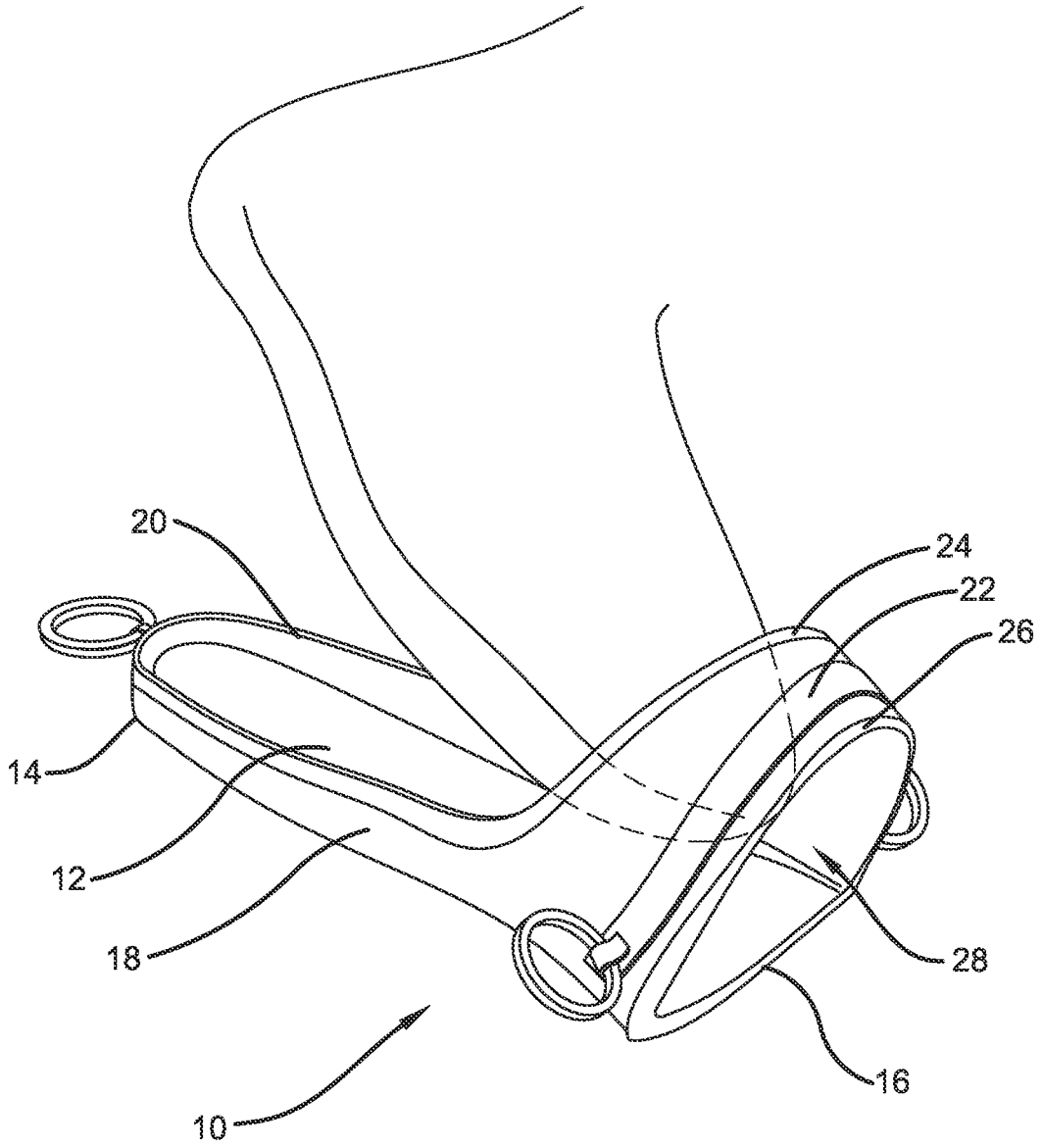
FIG. 1 is an isometric view of a slip shown with a user's foot partially entering the first opening.

Referring now to FIG. 1, a slip 10 that may be placed over the foot of a user in order to aid in various types of exercises may be seen. The slip 10 may be constructed from a number of different materials which allow for a secure fit around a user's foot. According to the embodiment shown in FIG. 1, the slip 10 is constructed from a molded rubber being of a generally flexible nature, or another similar material of a flexible and semi-elastic nature, such as a material having rubber-like properties. According to one embodiment, the slip 10 may be of a single, continuous mold such that the body of the slip 10 consists of only one piece, eliminating the need for any type of attachment or securement points consisting of multiple components. This construction allows for the slip 10 to be sufficiently firm so as to provide the user with a steady base when being used for various different types of exercises, while also retaining enough flexibility so as to contour around the size of the user's foot. Alternative embodiments may utilize a single, continuous mold structure of a single piece which further incorporates external securement points for attaching the resistance bands.

For example, the slip 10 may be roughly approximated in overall size according to common shoe sizes and measurements. A user may thus select a slip 10 which corresponds approximately to their shoe size, or possibly one size smaller than what they would normally wear. Other embodiments may classify different slips according to a conventional size gradient (i.e., small, medium large, etc.), the slips may be customized roughly to the size of a particular user's foot, or any other different sizing options as identified by those having skill in the art may be used. The molded rubber construction of the slip 10 thus allows it to expand, or stretch, within a given tolerance so as to adjust to the approximate size of the user's foot, as will be discussed in greater detail with reference to the accompanying FIGURES.

Once the user's foot is inserted into the slip 10, the slip 10 seeks to return to its original state, thus exercising a certain amount of restorative force such that the back portion of the slip 10 comes into contact with, and rests upon, the posterior of the heel of the user. Those having ordinary skill in the art will appreciate that this design of the slip 10 may thus incorporate a number of different materials of construction, other than that of the molded rubber design discussed herein, capable of exercising such a restorative force so as to be able to expand around the contours of a user's foot or shoe, and then retract about so as to create a secure fit.

Returning now to FIG. 1, the slip 10 may be generally defined by a base 12 which extends longitudinally from a raised backing 14. The base 12 and the raised backing 14 are positioned substantially perpendicular to one another. The base 12 extends away from the raised backing 14 in a generally flat trajectory until reaching an end at the exposed front face 16. However, alternative embodiments of the base may occur in different configurations, including a full, partial, or interrupted surface, as well as other features, and may also differ according to size, in order to work in conjunction with the material characteristics with the intention to facilitate the flexibility of the device to allow for ease of insertion of the foot while also balancing rigidity and material memory to support a secure fit to the user's foot or shoe. The front face 16 is defined by a substantially flat, "cut-off" portion of the base 12. The base 12 is further defined by a pair of opposing sidewalls, first sidewall 18 and second sidewall 20, which extend vertically away from, and about the lateral edges of, the base 12. Each of the first and second sidewall, 18 and 20, are positioned substantially perpendicular to that of the base 12. The distance located between each of the respective sidewalls 18 and 20, or the width of the base 12, is controlled by the size of the slip 10 being created. For example, when a larger slip is being created for use with a correspondingly larger foot, the width of the base will be greater than when a smaller slip is being created for a correspondingly smaller foot.

With continued reference to FIG. 1, the raised backing 14 extends vertically away from the base 12 so as to create a lipped feature for creating a secured, "cupping" relation to the posterior of the heel of a user's foot. The height to which the raised backing 14 extends away from the base 12 may be chosen by those having skill in the art. For example, the backing may extend to a height of anywhere between approximately 0.25 inches-5 inches relative to the base 12. Each of the first and second sidewalls, 18 and 20 respectively, may similarly extend vertically away from that of the base 12. The height to which each of the sidewalls 18 and 20 extend away from the base 12 may similarly be chosen by those having skill in the art. According to certain embodiments, the height of the first and second sidewalls 18 and 20 may extend to a height between approximately 0.25 inches-5 inches relative to the base 12.

According to the embodiment shown in FIG. 1, the height of each of the sidewalls 18 and 20 gradually increases about the gradient as the respective sidewalls extend about the length of the base 12 towards the front face 16. The particular embodiment shown in FIG. 1 utilizes a uniform gradient of progression for each of the first sidewall 18 and second sidewall 20 as they extend about the length of the base 12 and towards the front face 16. Similar to that of most articles designed in association with human feet, such as shoes, socks, or other types of footwear, the slip 10 is contemplated as being accompanied by a mate, or corresponding second slip (not shown). When the vertical heights of the respective first and second sidewalls 18 and 20 are uniform to one another, the two mating slips may be substantially identical to one another, thereby not requiring any designation between a "right" and "left" slip, as each of the respective slips may be worn on either foot of the user with equal levels of securement and comfort.

However, additional embodiments may alter such vertical heights to which the respective sidewalls 18 and 20 extend relative to the base 12. Other such embodiments may include defining the first sidewall 18 by extending to a height lesser than that relative to the second sidewall 20, or alternatively defining the first sidewall 18 by extending to a height greater than that relative to the second sidewall 20. When viewing the corresponding mate to such a slip, the heights of the corresponding sidewalls may thus be reversed, wherein the height of the first sidewall 18 extends to a height greater than that relative to the second sidewall 20. This results in two slips being substantial mirror images of one another, similar to that of a pair of shoes. As such, one slip may be designated as a "right" slip, designed for a more secured and comfortable fit on a user's right foot, and the corresponding slip designated as a"left" slip, designed for a more secured and comfortable fit on a user's left foot. Other embodiments of varying heights of the respective sidewalls 18 and 20 may also be used as identified by those having skill in the art without deviating from the present disclosure.

Continuing with FIG. 1, each of the first and second sidewalls 18 and 20 continue to extend towards the front face 16. At a designated location along this gradient of progression, each of the respective sidewalls 18 and 20 will begin to extend further away from the base 12 and begin to arch towards one another over top of the base 12, located below. The designated location of this extension of the sidewalls may be chosen by those having skill in the art. According to the example shown in FIG. 1, this location may be approximated by the location corresponding to roughly the midpoint of the corresponding user's foot when measured from the posterior of the heel to the tip of the toe, relative to the size of the slip being created. Another embodiment may place this designated location relative to where the slip will correspond with the beginning of the ball of the foot when measuring the foot beginning at the posterior of the heel. Various other embodiments may utilize differing locations along the gradient of progression of the sidewalls without departing from the present disclosure.

The trajectory of the respective sidewalls 18 and 20 as they continue to arch towards one another can create a semi-circular, or arch-like opening, or other suitably shaped opening, relative to the base 12. The arched opening, or band 22, is defined by having a width represented by a first edge 24 and a second edge 26, with the first edge being positioned at a location closer to that of the raised backing 14. The width of the band 22 is thus defined by the distance between that of the first edge 24 and second edge 26, with the second edge 26 being further defined by being substantially in the same vertical plane as that of the front face 16, such that the front surface of the slip 10 is defined by that of the location of each of the front face 16 and second edge 26. However, an alternative embodiment may utilize an "offset" approach, wherein the second edge 26 lies in a different vertical plane than that of the front face 16, being either recessed in towards the first edge 24, or overhanging that of the front face 16. The distance between that of the first and second edges, 24 and 26 respectively, otherwise referred to as the width of the band 22, may vary according to the design requirements of those having skill in the art based upon the size of the slip 10. According to various embodiments, the width of the band 22 is approximately between 0.25 inches-4 inches.

The space located between the underside of the band 22 and the base 12 creates a first opening 28. This first opening 28 is defined by having a substantially flat surface on the bottom region, being that of the base 12, and an opening on the top region, as defined by the underside of the band 22, which can be of an arch-like or semicircular shape. The geometric shape of the first opening 28 can thus be substantially semicircular in nature or can have any other suitable shape based on material selection or molding technique. The height of the first opening 28, as measured from the base 12 to that of the furthest point of the band 22, is determined according to the relative size of the slip 10. For example, when a larger slip is being created for use with a correspondingly larger foot, the height of the first opening 28 will be greater than when a smaller slip is being created for a correspondingly smaller foot. The first opening 28 is thus sized so as to receive the foot of the user when inserted with the toe region facing towards the front face 16, as illustrated and discussed in greater detail with reference to FIG. 2.

Figure 2:
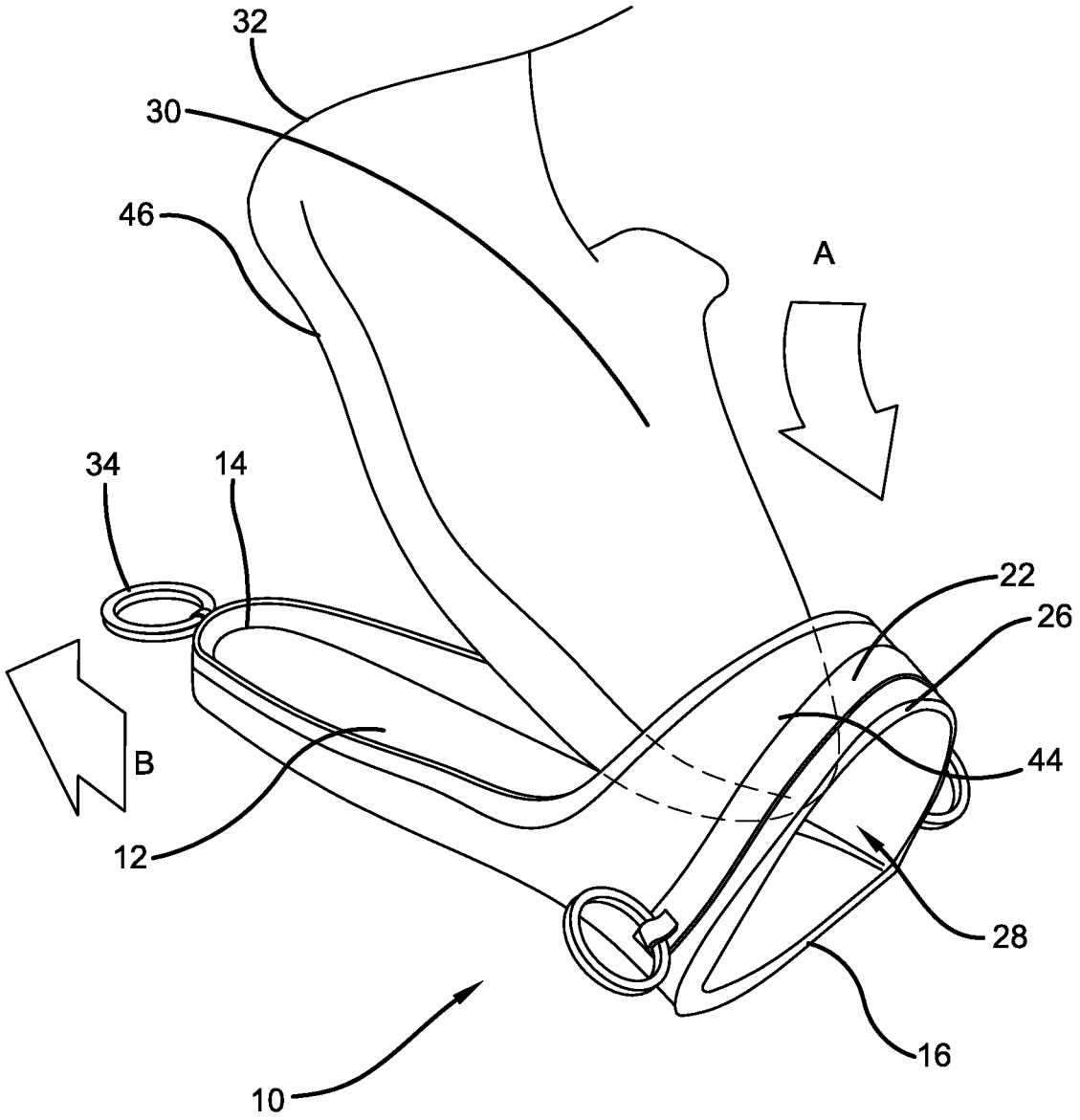
FIG. 2 is a reproduction of FIG. 1, with additional indicators that aid in the alignment of a slip on a user's foot.

With reference now to FIG. 2, the toe region 44 of a user's foot 30 may be inserted through that of the first opening 28 according to the direction defined as A. The toe region 44 of the user's foot 30 will thus pass underneath that of the band 22, thereby extending beyond that of each of the front face 16 and second edge 26. The user's foot 30 may continue to pass through the first opening 28 until a designated point as defined by the specific anatomy of the foot, with the bottom surface 46 of the user's foot 30 contacting the base 12. For example, the user's foot 30 may pass through the first opening 28 until such a point where the raised portion of the top of the foot designated by the bone structure thereof comes into contact with the first edge 24 defining the band 22.

Another example may include the user's foot 30 passing through the first opening 28 until the posterior of the heel 32 of the user's foot 30 becomes substantially aligned with that of the inner face of the raised back 14. Once the user's foot 30 becomes so positioned, the raised backing 14 may be partially extended away from that of the front face 16 according to the direction defined as B in FIG. 2, causing the length of the base 12 to elongate longitudinally. The raised backing 14 may be extended in such a direction by grabbing the raised backing 14, or alternatively by pulling on a securement point, such as the first O-ring 32, or other means of securement, affixed to the exterior of the raised backing 14. The various securement points, such as first O-ring 32, will be discussed in greater detail in association with the remaining FIGURES below.

The extent to which the raised backing 14 is extended in the B direction will depend upon the exact geometry of the user's foot 30, in addition to the specific dimensions of the slip 10. Ultimately, this distance will be defined as that necessary to allow for the posterior of the heel 32 of the user's foot 30 to be secured within that of the interior of the raised backing 14. Upon insertion of the toe region 44 of the user's foot 30 according to the A direction, the raised backing 14 may be released by ceasing all exertion of force in the B direction. Upon the cessation of force in the B direction, the raised backing 14 will begin to contract back towards that of the front face 16, resulting in the length of the base 12 to begin returning to its original, or "resting" length, as exhibited prior to the exertion of any such force in the B direction. The raised backing 14 will continue to contract in such a manner until either reaching its original resting state, as defined as the length of the base 12 prior to the exertion of force in the B direction, or until contacting the posterior of the heel 32 of the user's foot 30.

If the raised backing 14 is permitted to contract all the way back to its original resting state, then the toe region 44 of the user's foot 30 may have been inserted too far in the A direction through the band 22, or alternatively the slip 10 chosen may be too large for the corresponding foot of the user. In such circumstances, the user should attempt to make adjustments with regards to the level of insertion of the toe region 44 in the A direction by sliding the foot 30 back away from the front face 16. If such adjustments result in discomfort or an unsecured fit of the band 22 around the user's foot 30, then a smaller slip should be chosen.

Figure 3:
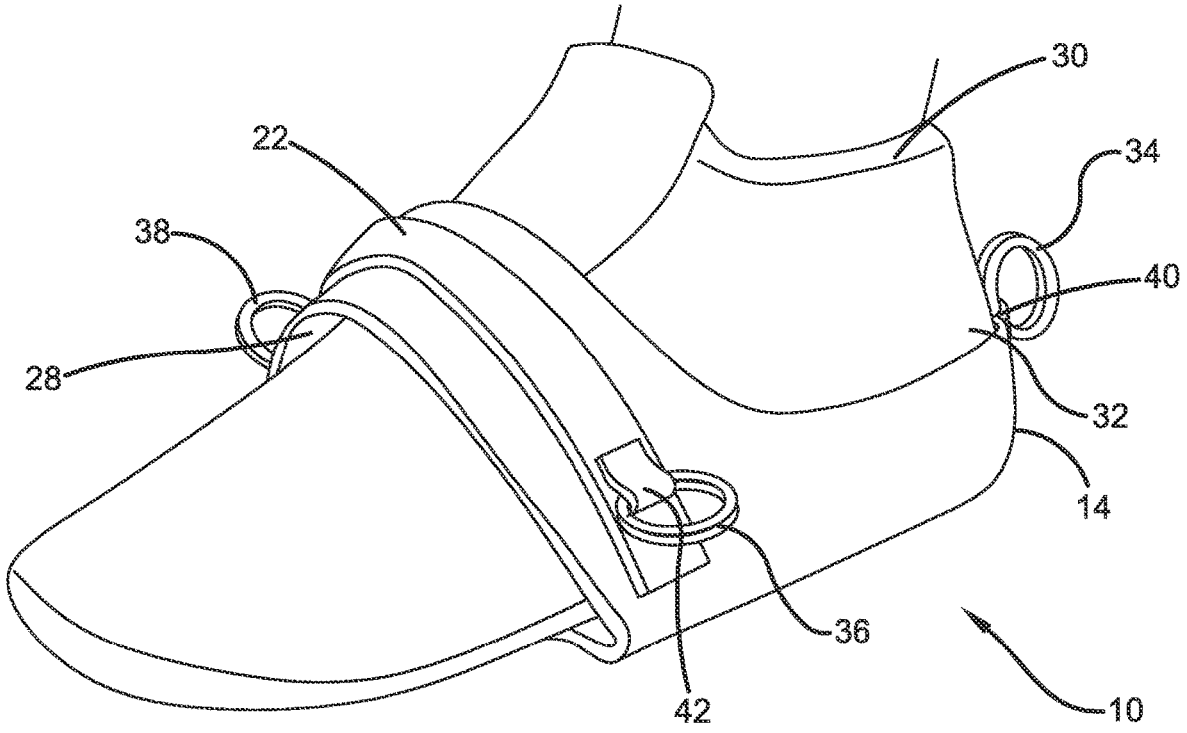
FIG. 3 is an isometric view of a slip when secured to a user's foot.

With reference now to FIG. 3, the slip 10 is shown with the toe region 44 of the user's foot 30 being fully inserted through the first opening 28 such that the posterior of the heel 32 is secured in place by the raised backing 14. While the embodiment shown in FIG. 3 illustrates the user's foot while wearing a shoe, those having skill in the art will appreciate that the slip 10 may be utilized according to any different number of combinations of outer garments, or lack thereof, with regards to the user's foot 30. For example, according to various other embodiments, the slip 10 may be placed directly onto a user's bare foot or a user's foot having a sock or stocking placed thereon.

The slip 10 may have securement points located about the exterior face which allow for the securement of exercise bands thereto. The securement points may take the form of any different number of designs as identified by those having skill in the art for safely and securely attaching to an exercise band. The number of securement points positioned about the exterior of the slip 10 may vary from as few as one to as many as are requested by a user. Examples of the securement points may include: O-rings, clips, hook and loop fasteners, clamps, retaining rings, double end snap clips, release pins, U-type fasteners, C-clips, J-clips, or any other means of securement identified by those having skill in the art.

According to the embodiment shown in FIG. 3, a series of O-ring type attachments may be affixed to the exterior of the slip 10 so as to securely fasten various different types of exercise equipment thereto, such as exercise bands or resistance cables. According to the embodiment shown in FIG. 3, there may be three separate such O-ring attachments: a first O-ring attachment 34; a second O-ring attachment 36; and a third O-ring attachment 38. Additional variations of the O-ring attachments affixed to the slip may be identified by those having skill in the art without deviating from the present disclosure. For example, a slip may have only a single O-ring attachment, two O-ring attachments, or any different number of O-ring attachments greater than three. Additional means of securely fastening exercise equipment to the slip may be used other than that of the O-ring type attachments shown in FIG. 3. According to other embodiments, the securement means may comprise, but are not limited to, hook and loop type fasteners, hook and eye fasteners, clips, clasps, straps, or any other securement means as identified by those having skill in the art.

Returning now to the embodiment shown in FIG. 3, a first means of securement is provided for by a first O-ring 34. The first O-ring 34 is comprised of a loop which is secured to a first protrusion 40 extending away from the exterior of the slip 10 which creates a covered opening on the reverse side of the slip 10, affixed to the raised backing 14. This places the first O-ring 34 roughly about the posterior of the heel 32 of the user's foot 30. The first protrusion 40 may be molded directly to the exterior of the slip 10, of through the wall of the slip 10, on the interior of the slip 10, or in any other suitable manner. The first protrusion 40 may alternatively be comprised of a material which is affixed to the surface of the exterior of the slip 10. The first O-ring 34 may thus pass through the covered opening created by the first protrusion 40.

According to one embodiment, the first O-ring 34 is a key ring or split ring of a double loop design, allowing for the first O-ring 34 to be slid along the spiral and thereby engage the covered opening of the first protrusion 40. When the first O-ring 34 is of such a design, it may be easily removed and replaced according to the current demands of the exercise being performed by the user. The end of an exercise band may thus be secured to that of the first O-ring 34 such that the slip 10 becomes an anchoring unit therefore. For example, the exercise band may be fitted with a similar key ring or split ring about the end which opposes the handle, or placed in the center between two opposing handles. Alternative designs may include different types of clips, clamps, or any other types of fasteners as commonly used in the industry which may be secured to the first O-ring 34.

With continued reference to FIG. 3, a second O-ring 36 may be positioned about either of the lateral sides of the slip 10, affixed to the exterior face of the band 22. The second O-ring 36 may be of any of the various designs or configurations as mentioned above with regards to the first O-ring 34. According to the embodiment as shown in FIG. 3, the second O-ring 36 is affixed to a second protrusion 42 which extends away from the exterior face of the band 22. The second protrusion 42 may be of any of the various designs or configurations as discussed above with regards to that of the first protrusion 40. When the second O-ring 36 is of a key ring or split ring design, as shown in FIG. 3, it may be secured to the covered opening created by the second protrusion 42 by being slid along the spiral and thereby engage the covered opening of the second protrusion 42.

With continued reference to FIG. 3, a third O-ring 38 may be positioned about the opposing lateral sides of the slip 10 to which the second O-ring 36 is placed, similarly affixed to the exterior face of the band 22. The third O-ring 38 may be of any of the various designs or configurations as mentioned above with regards to either of the first O-ring 34 or the second O-ring 36. According to the embodiment as shown in FIG. 3, the third O-ring 38 is affixed to a third protrusion (not shown) which extends away from the exterior face of the band 22 in much the same manner as that of either of the first or second protrusions, 40 and 42, respectively. The third protrusion may be of any of the various designs or configurations as discussed above with regards to that of the first protrusion 40 or second protrusion 42. When the third O-ring 38 is of a key ring or split ring design, as shown in FIG. 3, it may be secured to the covered opening created by the third protrusion by being slid along the spiral and thereby engage the covered opening of the third protrusion.

With continued reference to FIG. 3, an exercise band may be affixed to any different combination of the various O-rings 34, 36, and 38 according to the desires of the user. Examples may include securing a single band to one of the various O-rings in order to exercise a particular muscle or muscle group. Alternatively, a user may choose to affix a single band to one O-ring of a slip on one foot, and affix a second band to one O-ring of the corresponding "mate" slip on their other foot. Various combinations according to the above are possible based upon the specific desires of the user.

Figure 4:
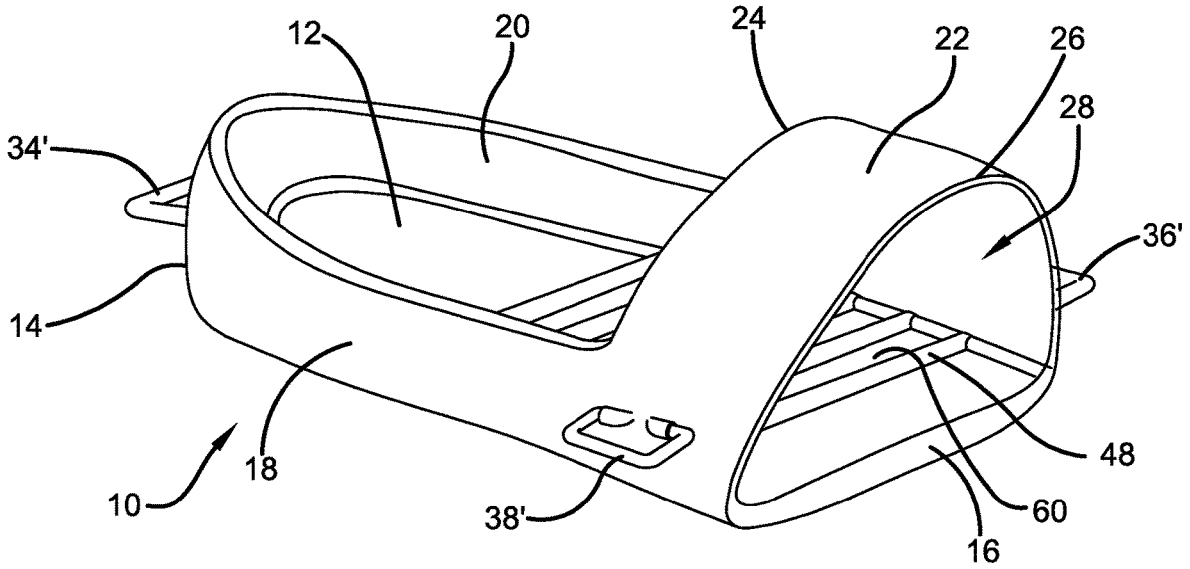
FIG. 4 is an isometric view of a slip having lateral support members.

With reference now to FIG. 4, a slip 10 is shown with alternative means of securement positioned about the exterior. In place of the O-rings 34, 36, 38, the means of securement according to the embodiment shown in FIG. 4 are replaced with C-clip receivers 34', 36', 38'. The C-clip receivers 34'. 36', 38' may be affixed in the same locations as that of the previously described O-rings 34, 36, 38 and capable of receiving an associated means of attachment from an exercise band, such as a traditional C-clip, or any other type of attachment as identified by those having skill in the art.

According to an alternative embodiment, the body of the exercise tubing may be inserted directly into the upper face of the base 12 prior to insertion of the user's. Upon the user's foot entering the slip 10, the tubing becomes "wedged" between the user's foot and the base 12. With continued reference to FIG. 4, the slip 10 may have at least one lateral restricting rib 48 which spans the width of the base 12, extending from the inner face of the first sidewall 18 to the inner face of the second sidewall 20. The at least one lateral restricting rib 48 is raised from the surface of the base 12 so as to create a gradient between the substantially flat surface of the base 12 and the volume of the restricting rib 48. While the force of the user's foot pressing against the tube and onto the base 12 provides some support, the restricting rib 48 helps to stabilize the tube and prevent further migration during use. According to certain embodiments, multiple restricting ribs 48 may be positioned substantially parallel to one another at a specified distance which is approximately equal to the width of the tubing. This arrangement allows for the tubing to more securely become "nested" within a slot created between two of the restricting ribs, such as tube slot 60 shown in FIG. 4. The ribs 48 also serve as a visual guide to where to place the foot/bands.

Figure 5:
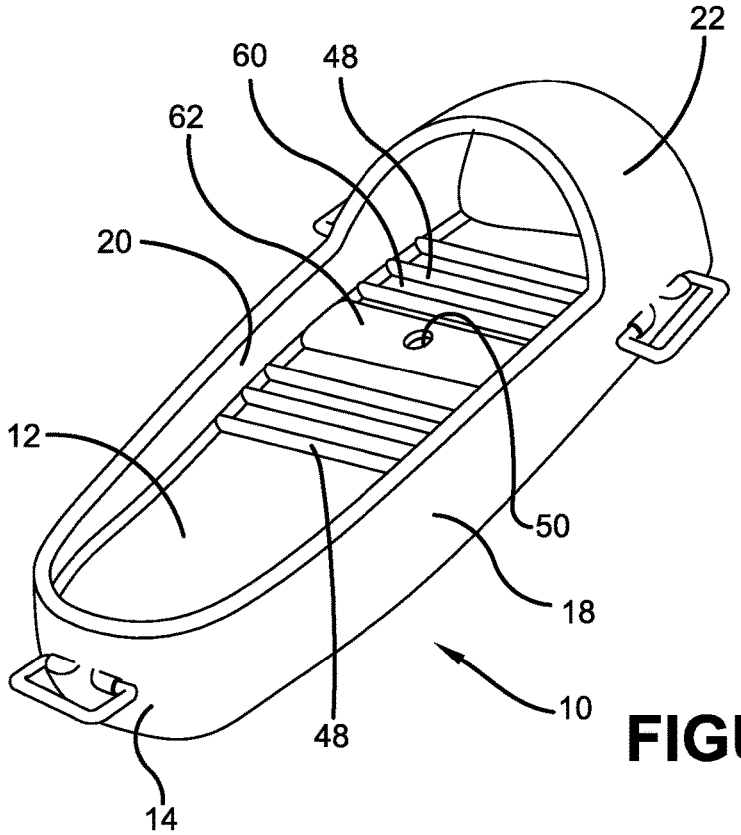
FIG. 5 is an alternative view from the rear perspective of a slip having lateral support members.

With reference now to FIG. 5, the various tube slots 60 may be of varying sizes based upon the spacing between the restricting ribs 48. According to one embodiment, the restricting ribs 48 may all be of uniform spacing between one another, while other embodiments may vary this spacing, for example by including a wider tube slot, central tube slot 62, which is to be located at a position intended for the desired location of the tubing. Located about one of the tube slots 60 may be a receiving slot 50. The receiving slot 50 may be an opening or cutout from the base 12 which aids in the ability to restrict the movement of the tube between the user's foot and the base 12. According to the embodiment shown in FIG. 5, the receiving slot 50 may be located in the central tube slot 62.

Figure 6:
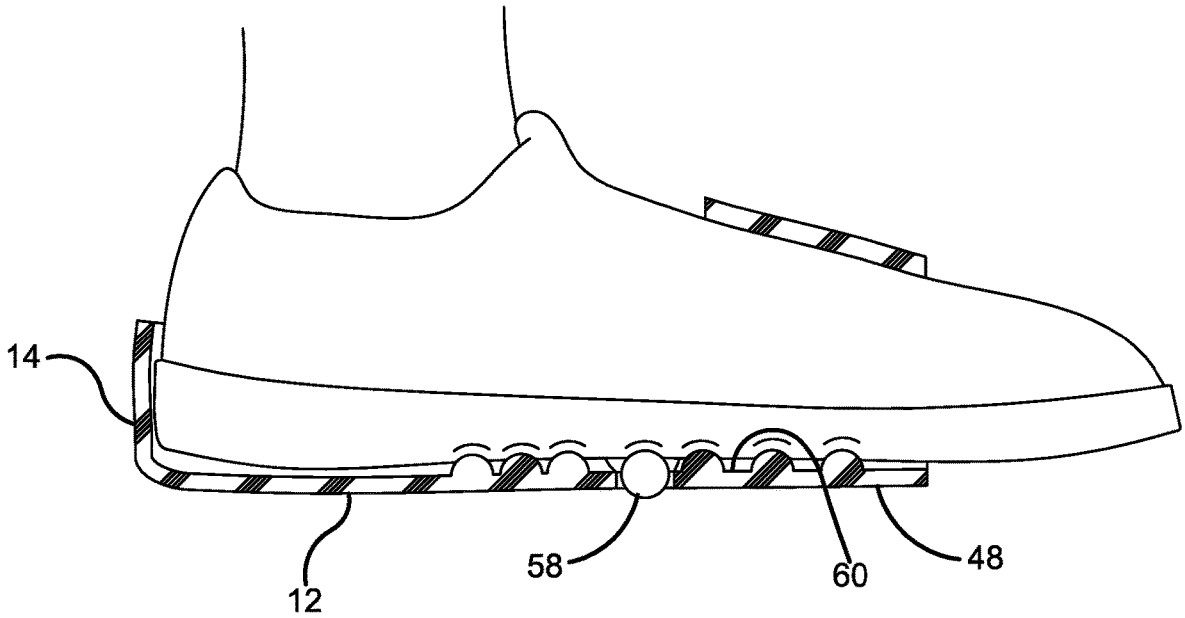
FIG. 6 is a side view of a slip having an opening which runs laterally about the base and extends from one sidewall to the other.

With reference now to FIG. 6, the slip 10 is shown from the side with exercise tubing 58 being laid across the top face of the base 12. FIG. 6 provides a collapsed view of the slip 10 such that the outer face of the slip 10 is not visible, thereby exposing the shoe located behind said face. This collapsed illustration allows for the location of the exercise tubing 58 to be seen as it is located within a particular tube slot.

Figure 7:
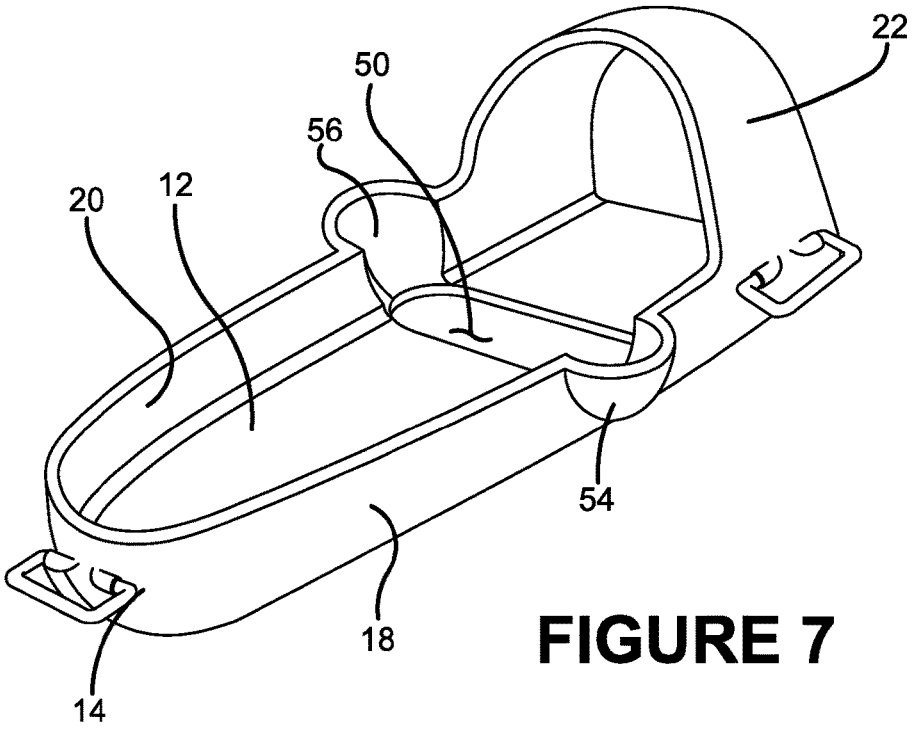
FIG. 7 is a rear view of a slip having an open slot in the base.

With reference now to FIG. 7, an alternative embodiment of a slip 10 is shown having first and second side notches 54 and 56, respectively. Each of the first and second side notches 54, 56 extend away from the respective sidewalls 18, 20, thereby providing a place for the exercise tubing to be better received by the slip 10 during applications where the exercise tubing is laid across the base 12 (as opposed to or in addition to securement to any external connectors). The dimensions of the first and second side notches 54, 56 may be chosen by those having skill in the art. According to the embodiment shown in FIG. 7, the side notches 54, 56 have a generally curved nature as they extend away from sidewalls 18, 20, allowing for the side notches 54, 56 to generally follow the curvature of the exercise tubing so as to create a more secured fit.

Figure 8:
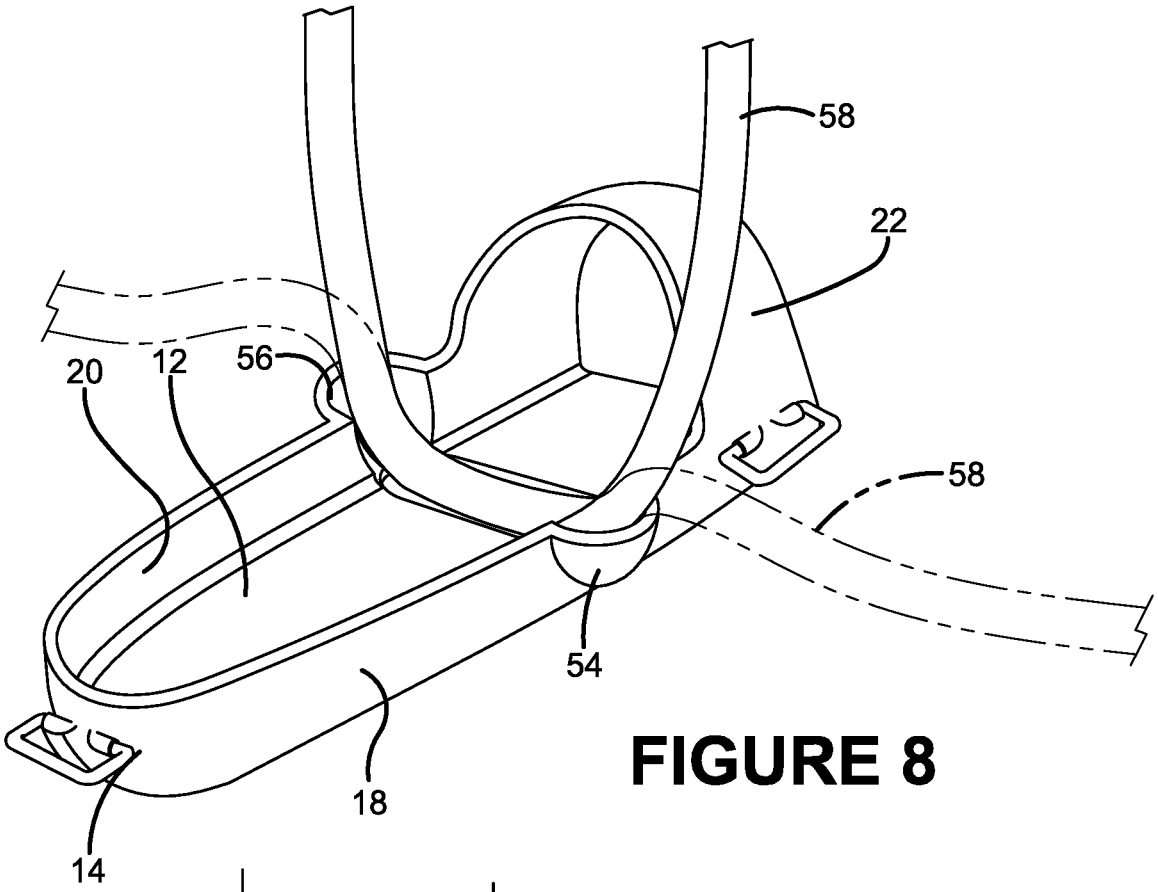
FIG. 8 is a rear view of a slip with bands placed about the surface of the base.
Figure 9:
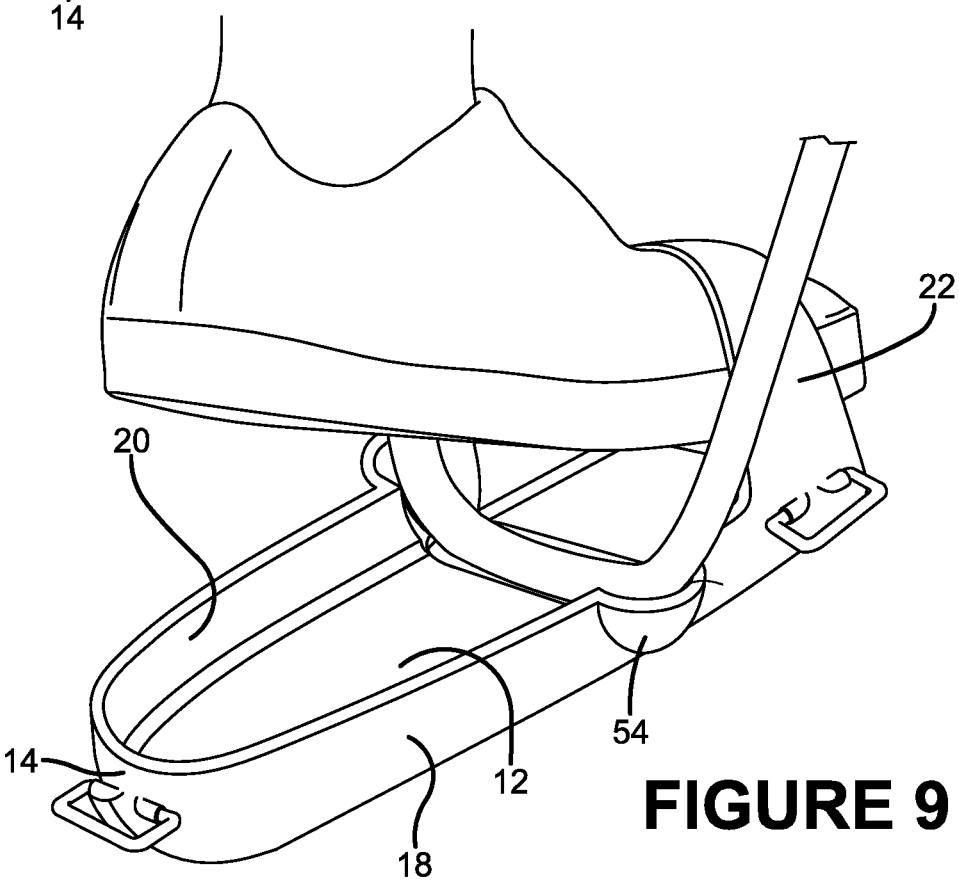
FIG. 9 is a rear view of a shoe being inserted into a slip with a band running through the side notches.
Figure 10:
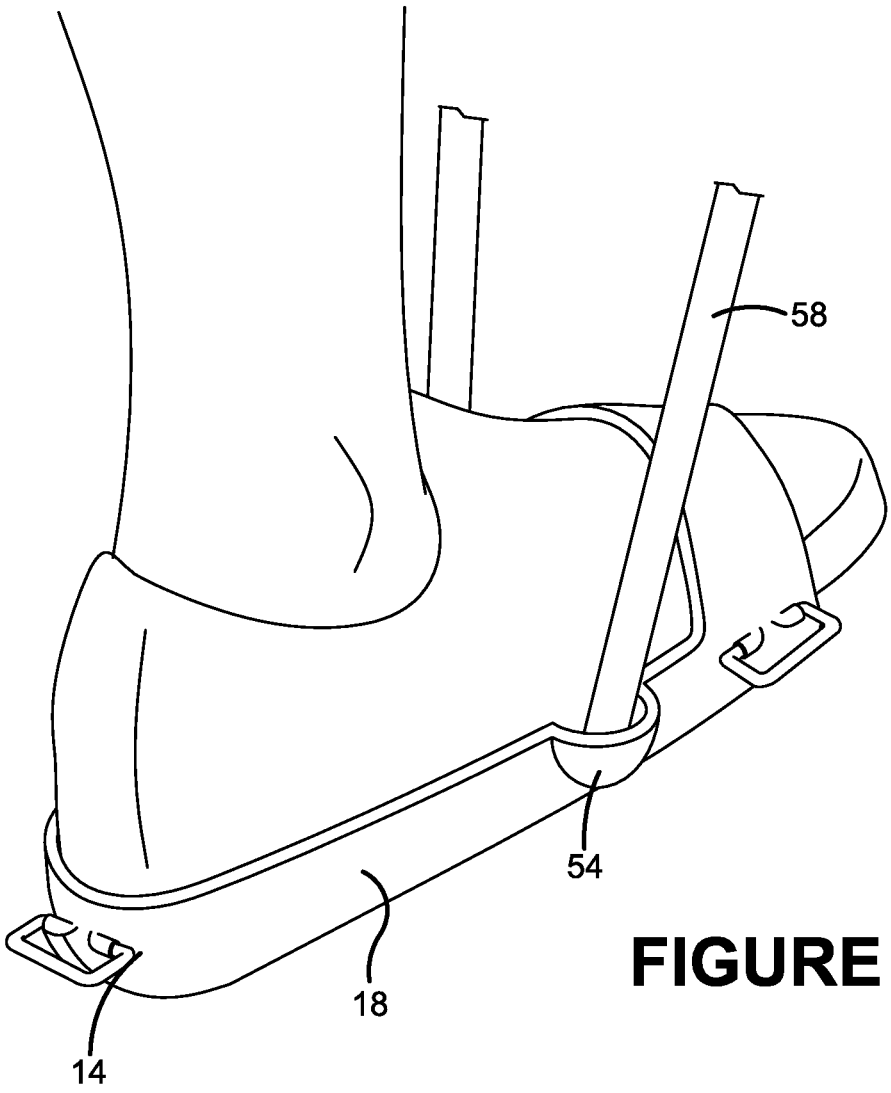
FIG. 10 is an isometric view of a slip placed around a shoe having a band running through the side notches.

Turning now to FIG. 8, exercise tubing 58 can be shown being laid across the slip 10. Exercise tubing 58 is shown when being drawn taught by a user, as well as during the application stage, wherein the exercise tubing 58 is laid loosely across the base 12 of the slip 10. FIG. 9 illustrates a user's foot being placed over top of the exercise tubing 58, with the exercise tubing 58 having already been laid across the base 12 and inserted into the first side notch 54. With reference to FIG. 10, the exercise tubing 58 is shown being pulled taught by a user, with said user's foot being placed in the slip 10. The first side notch 54 can be seen aiding in the securement of the exercise tubing 58 by providing a resting place for the exercise tubing 58.

Figure 11:
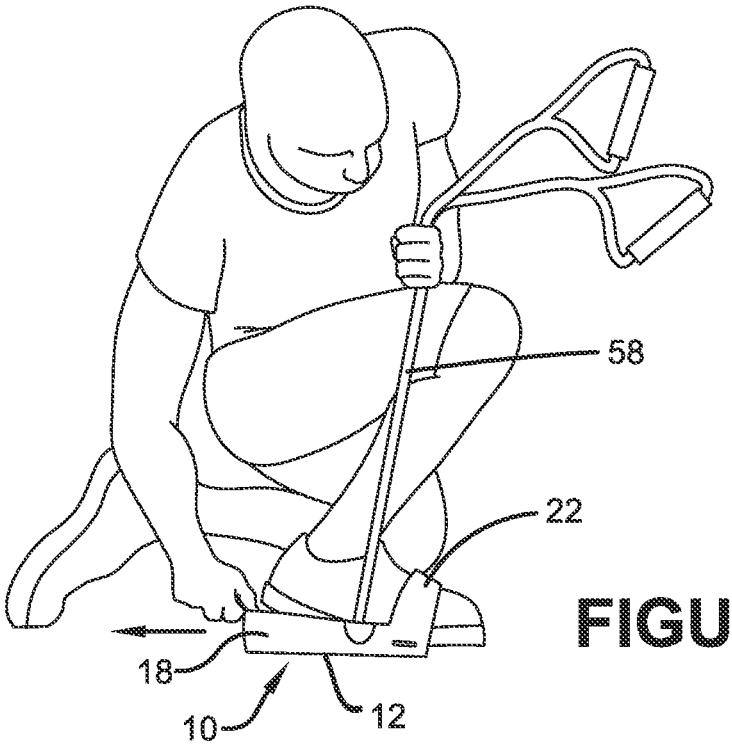
FIG. 11 shows a single-foot application of a slip.
Figure 12:
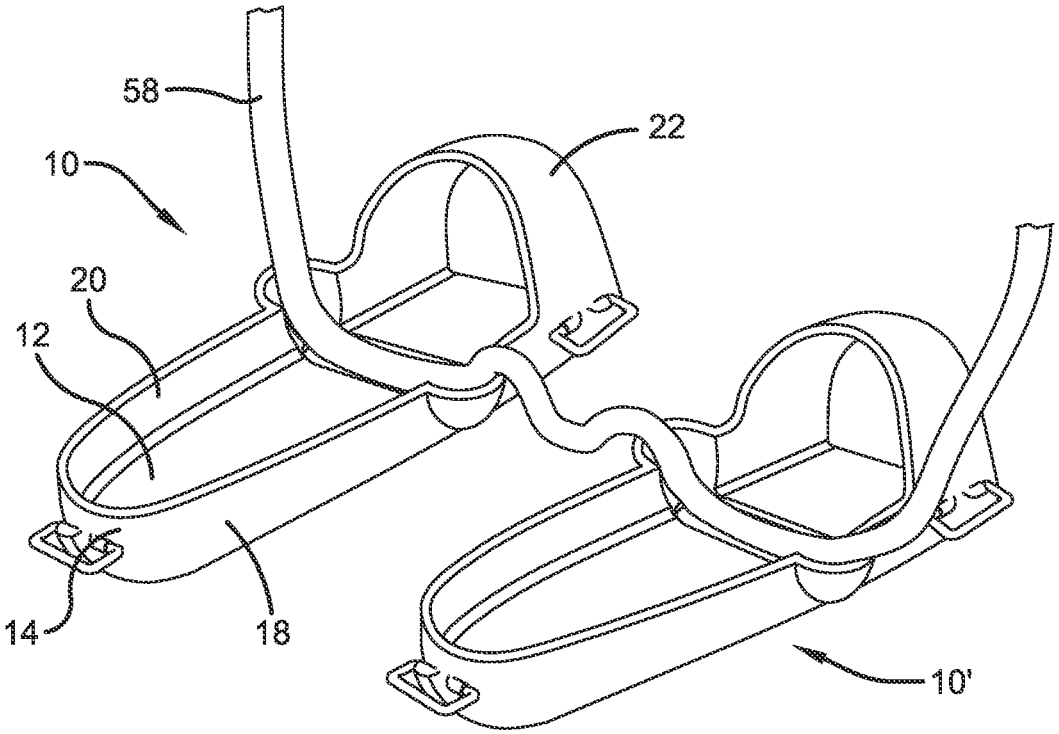
FIG. 12 shows a pair of slips configured for use as a double-foot slip design.
Figure 13:
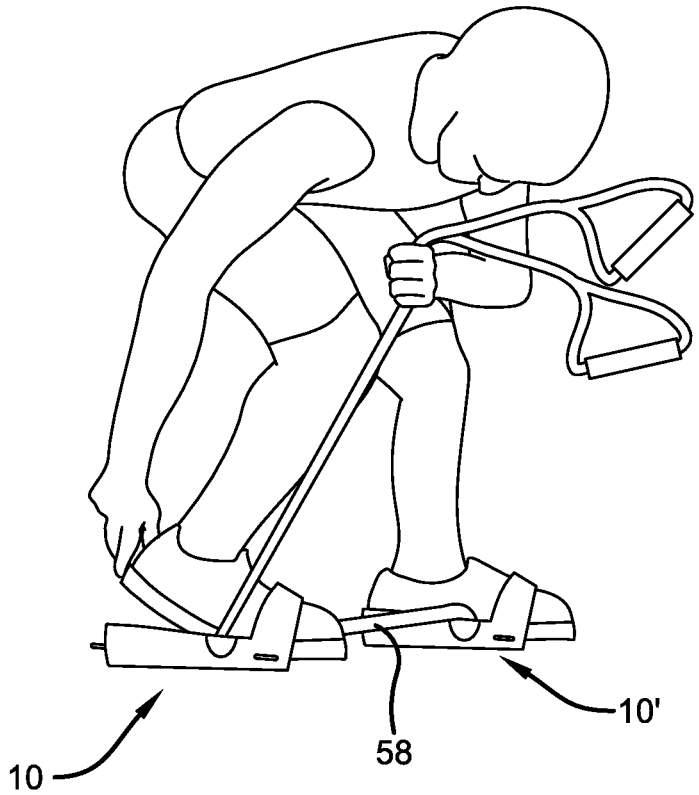
FIG. 13 shows a double-foot application of a pair of slips.
Figure 14:
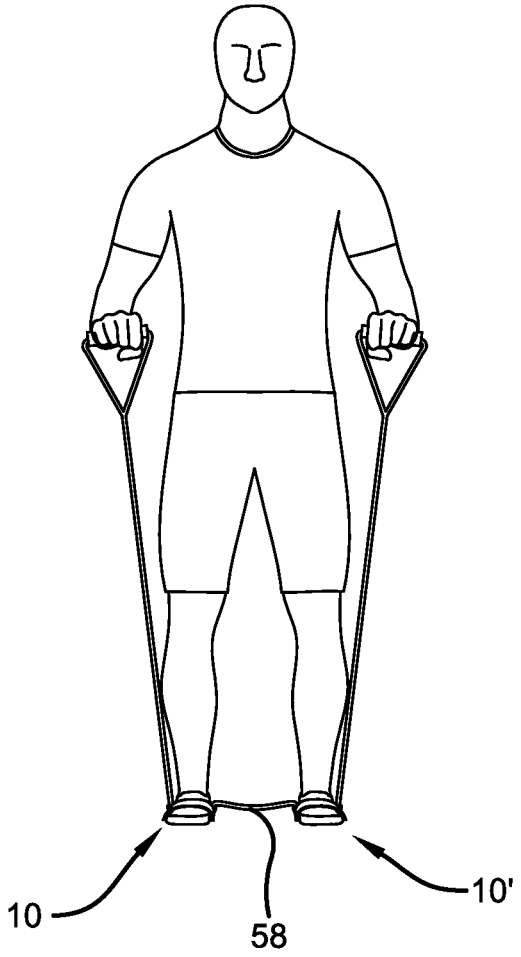
FIG. 14 is an alternative view of a double-foot application of a pair of slips.

With reference now to FIG. 11, a single-foot application is shown, where a user utilizes only a single slip 10 in conjunction with exercise tubing 58. FIGS. 12, 13, and 14 illustrate an alternative, double-foot application, where a user has a slip on each foot, slips 10 and 10', respectively. FIG. 12 illustrates how the exercise tubing 58 may be laid across both slips 10, 10' and received by the respective receiving notches on the slips. FIGS. 13 and 14 further illustrates how a user may utilizes the double-foot application after having laid the exercise tubing 58 across each of the slips 10, 10'.

As described above, the present disclosure has been described in association with various aspects thereof and it is understood that many changes and modifications to the described aspects can be carried out without departing from the scope and the spirit of the present disclosure that is intended to be limited only by the appended claims.

Having thus described the invention, it is now claimed:

1. A device placed over a foot, the device being an exercise aid device comprising:

a base;

a raised backing extending vertically away from said base;

a first sidewall extending vertically away from said base;

a second sidewall extending vertically away from said base;

a first opening defined by the base on a bottom of the base and a band on a top of the base, wherein said band is an intersection of the first and second sidewalls as the first and second sidewalls extend towards one another over the base at an end of the base opposite that of the raised backing, and;

at least one securement point positioned about an exterior of the exercise aid device for attaching at least one resistance cable in order to aid in exercise routines;

wherein the first opening is capable of receiving a toe region of a foot;

wherein the exercise aid device is constructed of a single piece of a molded rubber having a flexible and semi elastic nature to be sufficiently firm so as to provide a user with a steady base for exercise routines while also retaining enough flexibility so as to contour around the user's foot.

2. The device of claim 1, wherein each of the raised backing and first and second sidewalls are of uniform height as measured relative to the base as progressing across a gradient away from the raised backing.

3. The device of claim 1, wherein the first and second sidewalls gradually extend to a greater height as measured relative to the base as progressing across a gradient away from the raised backing.

4. The device of claim 1, wherein the first sidewall extends to a height relative to the base greater than that of the second sidewall.

5. The device of claim 1, wherein the at least one securement point is an O-ring or a C-clip.

6. The device of claim 5, wherein the at least one securement point is located on an exterior of the raised backing.

7. The device of claim 6, further comprising a second securement point and a third securement point, wherein said second and third securement points are located about an exterior of opposing lateral sides of the band, respectively.

8. The device of claim 7, wherein the second and third securement points are each an O-ring or a C-clip.

9. The device of claim 1, wherein the toe region is capable of receiving the toe region of the foot having a shoe.

10. The device of claim 1, wherein the first sidewall has at least one notch extending away from the base.

11. The device of claim 10, wherein the second sidewall has at least one notch extending away from the base.

12. A method of using an exercise aid device with resistance cables, the method comprising:

inserting a toe region of a foot into the exercise aid device, the exercise aid device comprising:

a base;

a raised backing extending vertically away from said base;

a first sidewall extending vertically away from said base;

a second sidewall extending vertically away from said base;

a first opening defined by the base on a bottom of the base and a band on a top of the base, wherein said band is an intersection of the first and second sidewalls; and at least one securement point;

extending the raised backing away from the first opening;

placing the foot flat on the base; and releasing the raised backing such that said raised backing contracts back towards the first opening and contacts a posterior of a heel of the foot;

wherein said exercise aid device serves as an anchoring unit for at least one of the resistance cables for performing exercises.

13. The method of claim 12, wherein the at least one securement point is an O-ring or a C-clip and the at least one of the resistance cables is secured to the at least one securement point.

14. The method of claim 13, wherein the at least one securement point comprises three securement points each being an O-ring or a C-clip, a first of the three securement points is located on an exterior of the raised backing, a second and a third of the three securement points are located about an exterior of opposing lateral sides of the band, respectively, and the at least one of the resistance cables is secured to at least one of the first, second, and third securement points.

15. The method of claim 12, wherein the at least one securement point is at least two ribs extending from the first sidewall to the second sidewall or a notch extending away from the base at each of said first and second sidewalls.

16. The method of claim 12, wherein the step of inserting the toe region of the foot further comprises placing one of the resistance cables underneath the foot such that the one of the resistance cables is located between the foot and the base.

* * * * *